US007686004B2

(12) United States Patent
Gan

(10) Patent No.: US 7,686,004 B2
(45) Date of Patent: Mar. 30, 2010

(54) PNEUMATIC PAINTBALL GUN

(76) Inventor: Yiauguo Gan, No. 388-1, Houjuang Road, Beitun Chu, Taichung (TW) 40682

( * ) Notice: Subject to any disclaimer, the term of this patent is extended or adjusted under 35 U.S.C. 154(b) by 739 days.

(21) Appl. No.: 11/505,160

(22) Filed: Aug. 15, 2006

(65) Prior Publication Data

US 2008/0041353 A1 Feb. 21, 2008

(51) Int. Cl.
*F41B 11/32* (2006.01)

(52) U.S. Cl. ..... 124/75

(58) Field of Classification Search ..... 124/73, 124/75, 76, 77

See application file for complete search history.

(56) References Cited

U.S. PATENT DOCUMENTS 2,554,116 A * 5/1951 Monner ..... 124/74
5,497,758 A * 3/1996 Dobbins et al. ..... 124/73
6,349,711 B1 2/2002 Perry et al. ..... 124/73
6,546,950 B1 4/2003 Juan ..... 137/270

* cited by examiner

*Primary Examiner*—Stephen M Johnson
(74) *Attorney, Agent, or Firm*—Banger Shia

(57) ABSTRACT

A gun device includes a housing having a gas supplying passage communicating with an inner chamber of the housing for coupling to a pressurized gas supplying source, a feed tube attached to the housing for feeding a bullet into the housing, a tubular member rotatably received in the housing and having an opening communicated with a bore of the tubular member for aligning with the feed tube and for selectively receiving the bullet into the bore of the tubular member. The opening of the tubular member is movable or disengageable from the feed tube when the tubular member is rotated relative to the housing for preventing the other bullet from entering into the housing.

11 Claims, 4 Drawing Sheets

PNEUMATIC PAINTBALL GUN

BACKGROUND OF THE INVENTION

1. Field of the Invention

The present invention relates to a pneumatic paintball gun, and more particularly to a pneumatic paintball gun including a simplified loading and firing mechanism for allowing the paintball or bullet to be easily and quickly loaded and to be effectively fired by pressurized air or gas.

2. Description of the Prior Art

Typical pneumatic paintball guns or bullet guns comprise a handgun shaped gun body including a hand grip for being held or grasped by the users, and including a loading assembly disposed in the upper portion of the gun body for feeding the paintballs or bullets into the firing chamber of the gun body one by one, and including a firing assembly disposed in the middle or lower portion of the gun body for firing the paintballs or bullets out of the firing chamber of the gun body.

For example, U.S. Pat. No. 6,349,711 to Perry et al. discloses one of the typical low pressure electrically operated pneumatic paintball guns also comprising an upper chamber formed in the upper portion of the gun body for receiving a loading assembly which may be used for feeding the paintballs or bullets into the firing chamber of the gun body one by one, and a middle or lower chamber formed in the middle or lower portion of the gun body for receiving a firing assembly which may be used for selectively firing the paintballs or bullets out of the firing chamber of the gun body.

However, the loading assembly and the firing assembly are separated from each other and include a relatively complicated structure having a number of parts or elements required to be manufactured and assembled such that the manufacturing processes are complicated and the manufacturing costs will be greatly increased.

U.S. Pat. No. 6,546,950 to Juan discloses another typical lacquer bullet gun comprising a firing device disposed in the upper portion of the gun body for feeding the paintballs or bullets into the firing chamber of the gun body one by one, and a gas entry valve disposed in the middle or lower portion of the gun body for controlling the pressurized air or gas to selectively flow into the firing chamber of the gun body and to fire the paintballs or bullets out of the firing chamber of the gun body when a trigger of the gun body is pulled or actuated by the users.

However, similarly, the firing device and the gas entry valve are separated from each other and the gun body is required to be formed with two chambers or passages therein for receiving the firing device and the gas entry valve respectively, such that the typical lacquer bullet gun also include a relatively complicated structure having a number of parts or elements required to be manufactured and assembled such that the manufacturing processes are complicated and the manufacturing costs will be greatly increased.

The present invention has arisen to mitigate and/or obviate the afore-described disadvantages of the conventional pneumatic paintball guns or lacquer bullet guns.

SUMMARY OF THE INVENTION

The primary objective of the present invention is to provide a pneumatic paintball gun including a simplified loading and firing mechanism for allowing the paintball or bullet to be easily and quickly loaded into the firing chamber and to be effectively fired by pressurized air or gas.

In accordance with one aspect of the invention, there is provided a gun device comprising a housing including an inner chamber formed therein and including a handle for being held by a user, and including a trigger for being actuated by the user, and including a gas supplying passage formed therein and communicating with the inner chamber of the housing for coupling to a pressurized gas supplying source and for selectively supplying the pressurized gas into the inner chamber of the housing, a feed tube attached to the housing for feeding a bullet into the inner chamber of the housing, a tubular member rotatably received in the inner chamber of the housing and including a bore formed therein, and including an opening formed therein and communicated with the bore of the tubular member for selectively aligning with the feed tube and for selectively receiving the bullet into the bore of the tubular member, and the opening of the tubular member acting to open or close the feed tube when the tubular member is rotated relative to the housing, a rotating device for rotating the tubular member relative to the housing, and a controlling device for controlling the pressurized gas to flow into the inner chamber of the housing and to fire the bullet.

The housing includes an inner peripheral shoulder formed therein for engaging with the tubular member and for rotatably anchoring the tubular member to the housing. The housing includes at least one sealing ring engaged between the tubular member and the housing for rotatably anchoring the tubular member to the housing.

The rotating device, i.e. the rotating means, includes at least one helical groove, an actuating rod and a pin. The helical groove is formed in the tubular member and is communicated with the bore of the tubular member. The actuating rod is slidably engaged into the bore of the tubular member, and the pin is attached to the actuating rod and has at least one end slidably engaged in the helical groove of the tubular member for rotating the tubular member relative to the housing with the actuating rod.

The housing includes a cylinder disposed in the inner chamber of the housing and having an inner space formed therein, the actuating rod is slidably engaged into the inner space of the cylinder. The cylinder includes a piston slidably received in the inner space of the cylinder for separating the inner space of the cylinder into a front compartment and a rear compartment, and a gasket disposed in the cylinder for slidably engaging with the actuating rod, the actuating rod is secured to the piston. The cylinder includes an end cap attached thereto for enclosing the inner space and the rear compartment of the cylinder.

The tubular member includes an outer peripheral channel formed therein and aligned with the gas supplying passage of the housing for receiving the pressurized gas from the gas supplying source. The tubular member includes a peripheral fence for forming the outer peripheral channel thereof, and the peripheral fence includes at least one aperture formed therein for communicating the outer peripheral channel with the bore of the tubular member and for allowing the pressurized gas to flow into the bore of the tubular member through the aperture of the peripheral fence.

The tubular member includes an orifice formed therein, the housing includes a spring-biased projection disposed therein and engageable into the orifice of the tubular member for selectively engaging with the bullet and for retaining the bullet in the bore of the tubular member when the orifice of the tubular member is aligned with the spring-biased projection.

The controlling device, i.e. the controlling means, includes a valve seat and a valve stem. The valve seat is provided in the tubular member. The valve stem is slidably received in the bore of the tubular member and has a valve member for selectively engaging with the valve seat of the tubular member and for selectively enclosing the bore of the tubular member. A spring biasing member, i.e. the biasing means, may further be provided for biasing the valve member to engage with the valve seat of the tubular member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
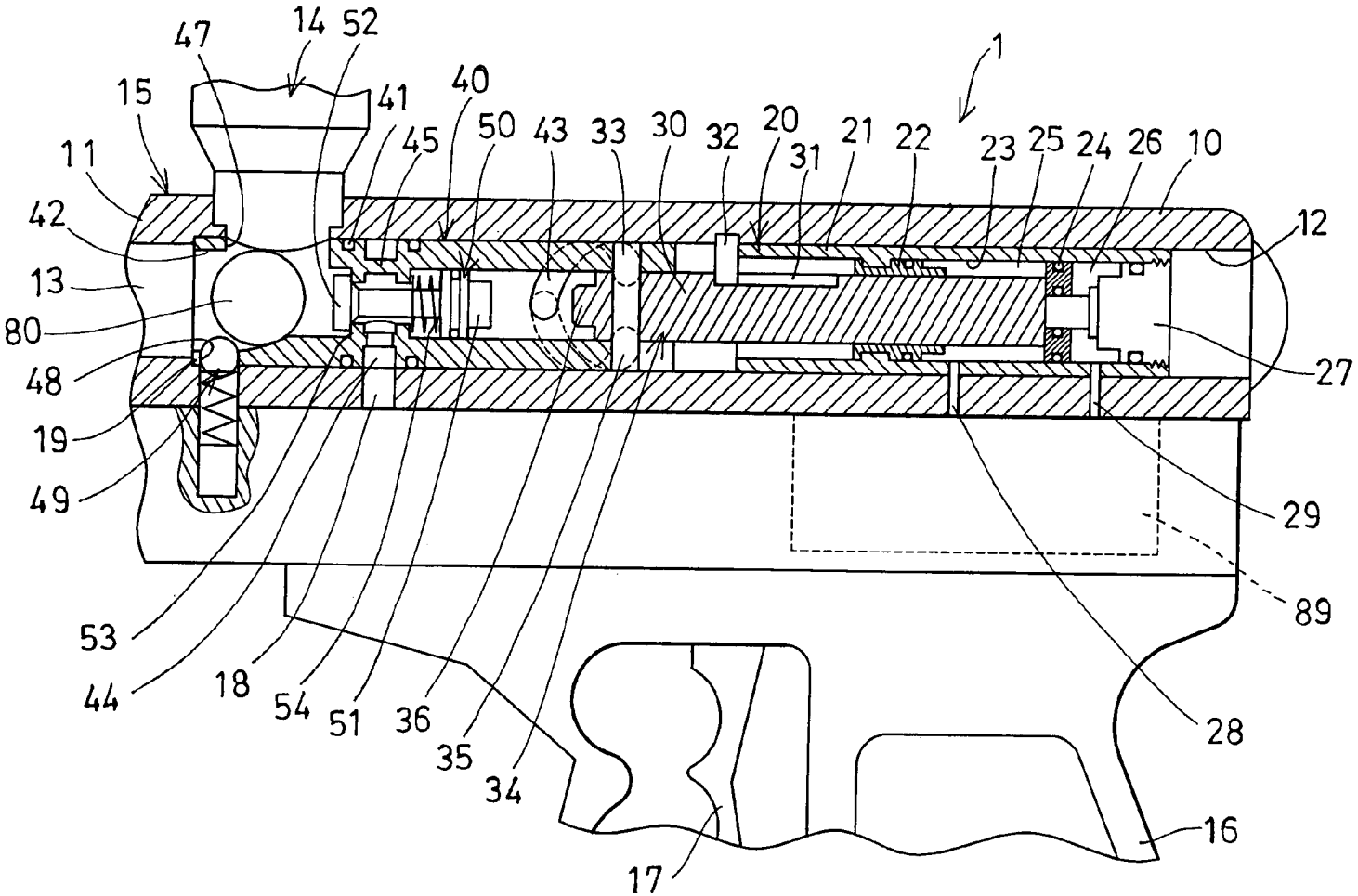
FIG. 1 is a partial cross sectional view of a pneumatic paintball gun or bullet gun device in accordance with the present invention.
Figure 4:
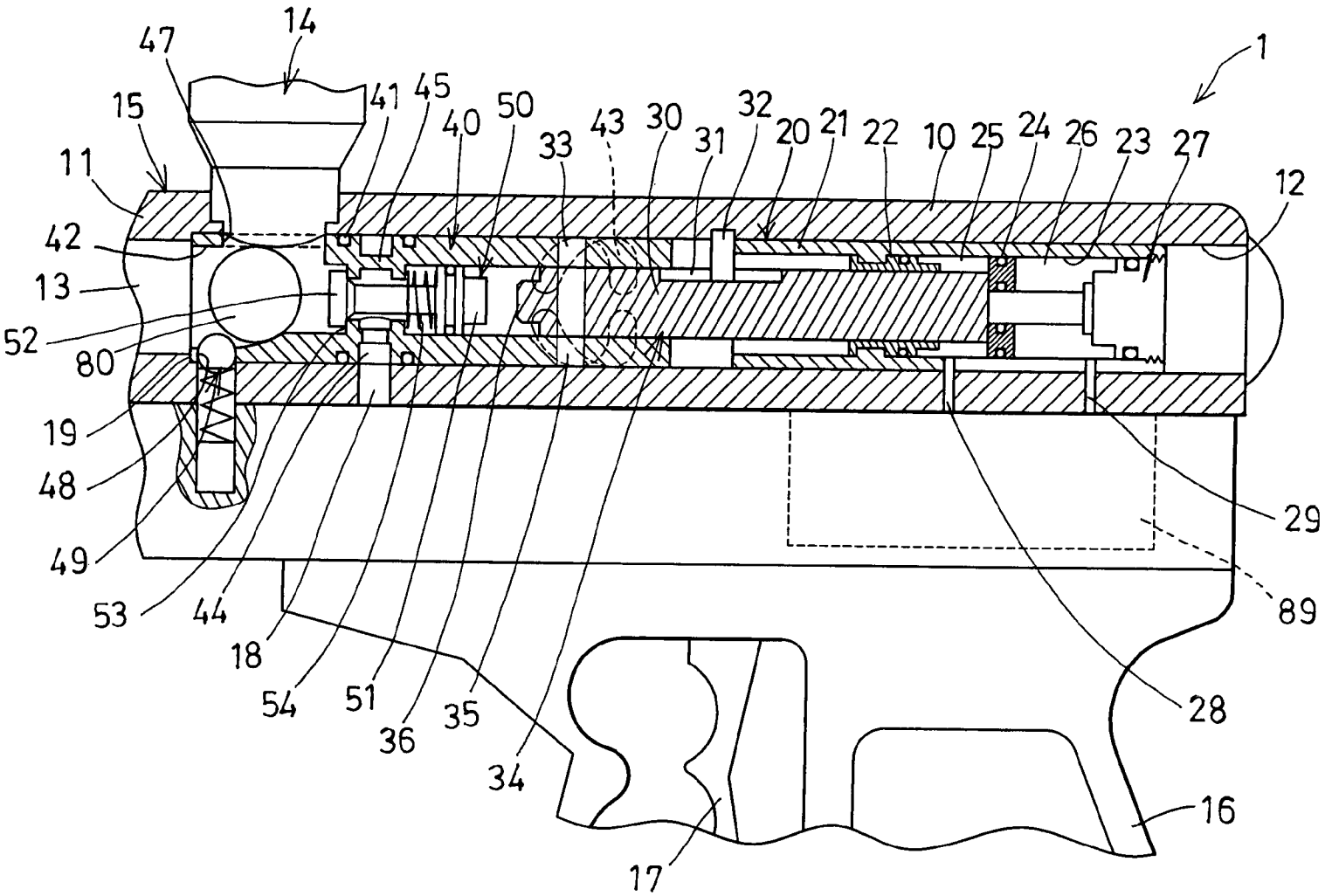
FIG. 4 is a partial cross sectional view similar to FIG. 1, illustrating the bullet loading operation of the pneumatic paintball gun or bullet gun device.
Figure 5:
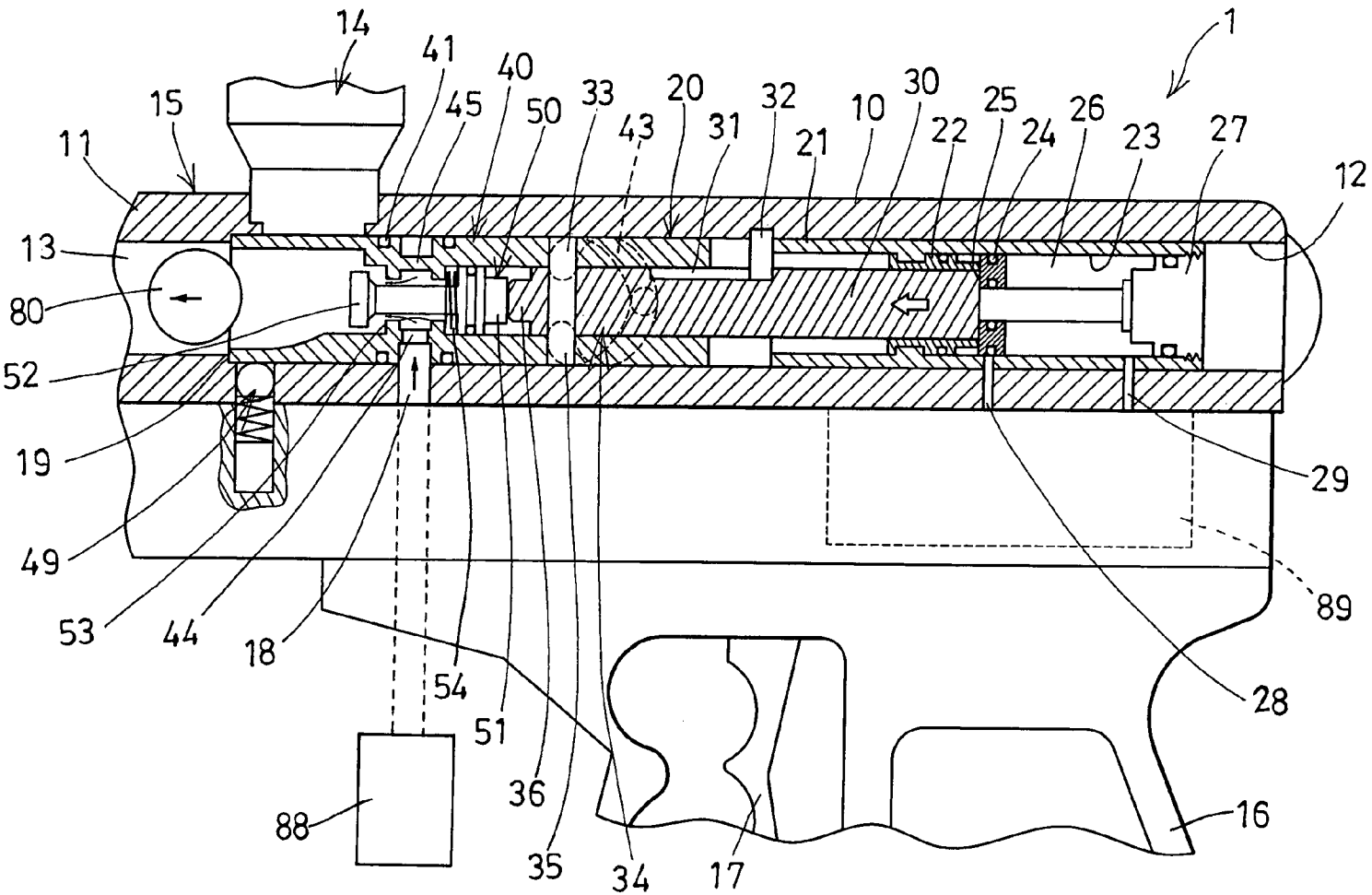
FIG. 5 is a partial cross sectional view similar to FIGS. 1 and 4, illustrating the bullet firing operation of the pneumatic paintball gun or bullet gun device.

Referring to the drawings, and initially to FIGS. 1 and 4-5, a pneumatic paintball gun or bullet gun device 1 in accordance with the present invention comprises a gun body or housing 10 with a gun barrel 11 secured to and projecting from the forward end of the housing 10. The housing 10 includes a longitudinal or inner chamber 12 formed therein and a firing chamber 13 provided or formed in the front portion of the housing 10 or of the gun barrel 11 for receiving a paintball or a bullet 80 therein, and a feed tube 14 attached or coupled to the front or middle portion 15 of the housing 10 for feeding or supplying the paintball or bullet 80 into the firing chamber 13 of the housing 10 one by one.

The housing 10 further includes a hand grip or handle 16 for being held or grasped by the users, and includes a trigger 17 for being pulled or actuated by the users, and includes a gas supplying passage 18 formed therein and communicating with the inner chamber 12 of the housing 10 for coupling to a pressurized air or gas supplying source 88 (FIG. 5), such as a pressure bottle 88 which may selectively supply the pressurized air or gas into the inner chamber 12 or the firing chamber 13 of the housing 10 in order to selectively fire the paintball or bullet 80 out of the firing chamber 13 of the housing 10. The housing 10 may further include an electric or pneumatic control device 89 disposed therein for controlling the firing of the pneumatic paintball gun or bullet gun device 10. However, the electric or pneumatic control device 89 and the pressurized air or gas supplying system are not related to the present invention and will not be described in further details.

A loading assembly or device 20 includes a cylinder 21 disposed or secured in the inner chamber 12 of the housing 10, a sealing ring or gasket 22 disposed or secured in the inner space 23 of the cylinder 21, and includes a piston 24 slidably received or disposed in the inner space 23 of the cylinder 21 and movable relative to the cylinder 21 and the housing 10 for separating the inner space 23 of the cylinder 21 into a front compartment 25 that is located between the gasket 22 and the piston 24 and a rear compartment 26, and an end cap 27 attached or secured to the rear portion of the cylinder 21 for enclosing the inner space 23 and the rear compartment 26 of the cylinder 21.

A piston rod or actuating rod 30 is slidably received or engaged in the inner space 23 of the cylinder 21 and slidably received or engaged in the gasket 22 for allowing the actuating rod 30 to be sealingly and longitudinally moved relative to the cylinder 21 and the housing 10, the actuating rod 30 is secured or coupled to the piston 24 and thus movable in concert with the piston 24. The housing 10 and/or the cylinder 21 may further include two gas flowing paths 28, 29 formed therein and communicating with the front compartment 25 and the rear compartment 26 of the cylinder 21 respectively for being controlled to selectively supply the pressurized air or gas into the front compartment 25 and the rear compartment 26 of the cylinder 21 respectively with such as the electric or pneumatic control device 89. The supplying or the controlling of the pressurized air or gas into the front compartment 25 and the rear compartment 26 of the cylinder 21 with the electric or pneumatic control device 89 is also not related to the present invention and will not be described in further details.

The actuating rod 30 includes a guide depression 31 formed therein, and the housing 10 and/or the cylinder 21 may further include a key 32 disposed therein or extended inwardly therefrom for slidably received or engaged in the guide depression 31 of the actuating rod 30 and for guiding and limiting the actuating rod 30 to move relative to the cylinder 21 and the housing 10. The actuating rod 30 further includes a pin 33 attached or secured to the front portion 34 thereof and disposed or arranged perpendicular to the actuating rod 30 and having a length greater than the outer diameter of the actuating rod 30 for allowing the pin 33 to have one or two ends 35 extended out of the actuating rod 30. The actuating rod 30 further includes an actuating end or member 36 provided or formed in the front end portion of the actuating rod 30.

A rotatable follower or tubular member 40 is rotatably received or engaged in the inner chamber 12 of the housing 10, such as engaged in the middle portion of the inner chamber 12 of the housing 10, and located in front of the cylinder 21, and rotatably secured to the housing 10 with one or more retaining rings or sealing rings 41, or the housing 10 includes an inner peripheral shoulder 19 formed therein for engaging with the rotatable tubular member 40 and for rotatably securing or anchoring the rotatable tubular member 40 to the housing 10 and for preventing the rotatable tubular member 40 from being moved longitudinally relative to the housing 10.

Figure 2:
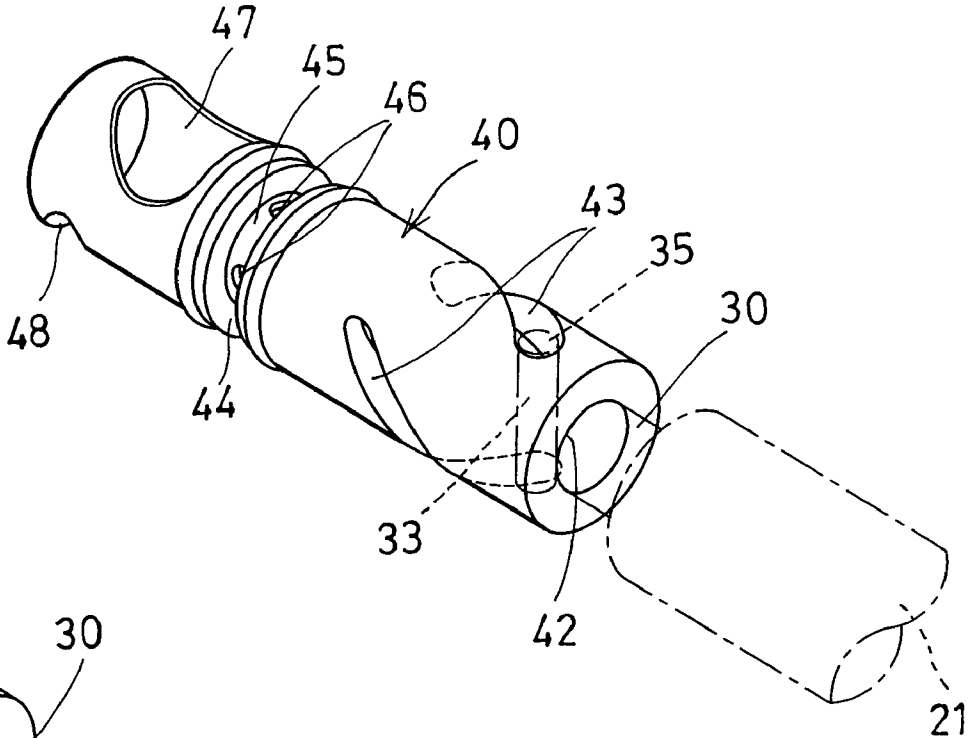
FIG. 2 is a partial perspective view illustrating a loading assembly or device of the pneumatic paintball gun or bullet gun device.
Figure 3:
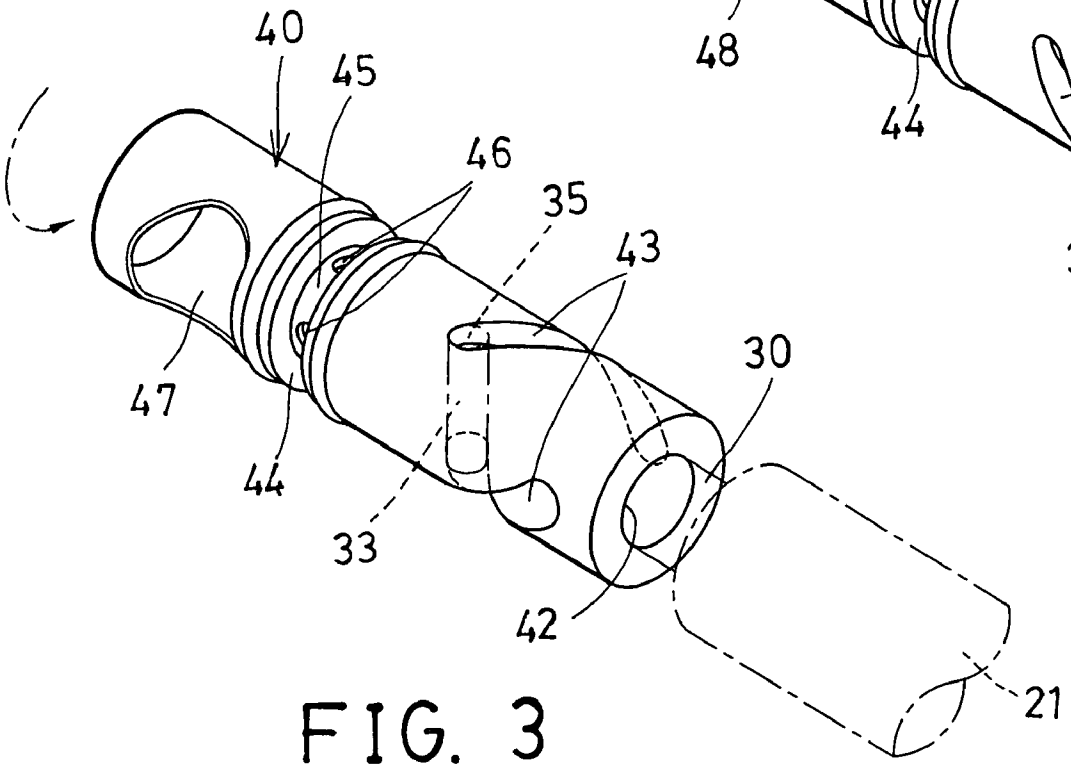
FIG. 3 is a partial perspective view similar to FIG. 2, illustrating the operation of the loading assembly or device of the pneumatic paintball gun or bullet gun device.

The tubular member 40 includes a bore 42 formed therein for slidably receiving the front portion 34 of the actuating rod 30, and includes one or more (such as two) helical grooves 43 formed therein, such as oppositely formed therein (FIGS. 2, 3) for slidably receiving or engaging with the ends 35 of the pin 33 and arranged for allowing the tubular member 40 to be rotated relative to the housing 10 by the pin 33 when the actuating rod 30 is longitudinally moved relative to the cylinder 21 and the housing 10. The tubular member 40 includes a peripheral channel 44 formed in the outer peripheral portion thereof and aligned with the gas supplying passage 18 of the housing 10 for receiving the pressurized air or gas from the supplying source 88.

The peripheral channel 44 of the tubular member 40 may be directly communicated with the bore 42 of the tubular member 40 for allowing the pressurized air or gas to flow into the bore 42 of the tubular member 40, or the tubular member 40 includes a peripheral fence 45 for forming or defining the peripheral channel 44 of the tubular member 40, and the peripheral fence 45 includes one or more apertures 46 formed therein for communicating the peripheral channel 44 with the bore 42 of the tubular member 40 and for allowing the pressurized air or gas to indirectly flow into the bore 42 of the tubular member 40 through the apertures 46 of the peripheral fence 45 and for allowing the pressurized air or gas to be supplied to fire the paintball or bullet 80.

The tubular member 40 further includes an opening 47 formed therein and communicated with the bore 42 of the tubular member 40 for selectively aligning with the feed tube 14 (FIGS. 1, 4) and for selectively receiving the paintball or bullet 80 into the bore 42 of the tubular member 40 or into the firing chamber 13 of the housing 10. The tubular member 40 further includes an orifice 48 formed therein (FIGS. 1, 2, 4) and preferably disposed or located opposite to the opening 47 of the tubular member 40, and a spring-biased projection 49 may be received or engaged in the housing 10 and selectively engageable into the orifice 48 of the tubular member 40 (FIGS. 1, 4) for engaging with the paintball or bullet 80 and for temporarily retaining the paintball or bullet 80 in the bore 42 of the tubular member 40 when the orifice 48 of the tubular member 40 is aligned with the spring-biased projection 49.

A valve device 50 includes a valve stem 51 received or engaged in the bore 42 of the tubular member 40, an enlarged valve member 52 formed or provided on or attached or secured to the front end of the valve stem 51 for selectively engaging with a valve seat 53 of the tubular member 40 (FIGS. 1, 4), and for selectively enclosing or blocking the bore 42 and the peripheral channel 44 of the tubular member 40, and a spring biasing means or member 54 is engaged between the tubular member 40 and the valve stem 51 for biasing or forcing the valve member 52 to engage with the valve seat 53 of the tubular member 40 and for preventing the pressurized air or gas from flowing out of the bore 42 of the tubular member 40 and from flowing into the firing chamber 13 of the housing 10. The valve stem 51 may be actuated or moved by the actuating rod 30 to selectively disengage the valve member 52 from the valve seat 53 of the tubular member 40 (FIG. 5).

In operation, as shown in FIG. 1, when the actuating rod 30 is moved rearwardly away from the valve device 50 or the tubular member 40, the opening 47 of the tubular member 40 may be aligned with the feed tube 14 to selectively receive the paintball or bullet 80 into the bore 42 of the tubular member 40 or into the firing chamber 13 of the housing 10, at this moment, the spring-biased projection 49 may be engaged into the orifice 48 of the tubular member 40 for engaging with the paintball or bullet 80 and for retaining the paintball or bullet 80 in the bore 42 of the tubular member 40.

The tubular member 40 may then be caused to be rotated relative to the housing 10 by the sliding engagement of the ends 35 of the pin 33 in the helical grooves 43 of the tubular member 40 when the actuating rod 30 is longitudinally and forwardly moved relative to the cylinder 21 and the housing 10, and the opening 47 of the tubular member 40 may be caused or rotated to close the feed tube 14 as shown in dotted lines in FIG 4, to prevent the other paintball or bullet 80 from moving into the bore 42 of the tubular member 40 and to safely retain the paintball or bullet 80 in the bore 42 of the tubular member 40.

When the actuating rod 30 is further moved forwardly relative to the cylinder 21 and the housing 10, as shown in FIG. 5, the opening 47 of the tubular member 40 may be rotated and completely close the feed tube 14, and the front actuating end or member 36 of the actuating rod 30 may then be forced or caused to engage with the valve stem 51 in order to move the valve stem 51 against the spring biasing member 54 and thus to selectively disengage the valve member 52 from the valve seat 53 of the tubular member 40. When the valve member 52 is disengaged from the valve seat 53 of the tubular member 40, the pressurized air or gas supplied from the supplying source 88 may thus flow into the bore 42 of the tubular member 40 and then flow into the firing chamber 13 of the housing 10 in order to fire the paintball or bullet 80.

It is to be noted that the typical pneumatic paintball guns or bullet guns failed to provide and to engage a tubular member 40 in the inner chamber 12 of the housing 10 and failed to provide an opening 47 in the tubular member 40 to selectively receive the paintball or bullet 80 and to selectively block and prevent the other paintball or bullet 80 from entering into the inner chamber 12 of the housing 10. The sliding engagement of the ends 35 of the pin 33 in the helical grooves 43 of the tubular member 40 may be used or acted as a rotating means for selectively rotating the tubular member 40 relative to the housing 10. The valve device 50 may be used or acted as a controlling means for selectively controlling the pressurized air or gas to flow into the bore 42 of the tubular member 40 and to fire the paintball or bullet 80.

Accordingly, the pneumatic paintball gun or bullet gun device in accordance with the present invention includes a simplified loading and firing mechanism for allowing the paintball or bullet to be easily and quickly loaded into the firing chamber and to be effectively fired by pressurized air or gas.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A gun device comprising:

a housing including an inner chamber formed therein and including a handle for being held by a user, and including a trigger for being actuated by the user, and including a gas supplying passage formed therein and communicating with said inner chamber of said housing for coupling to a pressurized gas supplying source and for selectively supplying the pressurized gas into said inner chamber of said housing, a feed tube attached to said housing for feeding a bullet into said inner chamber of said housing, and arranged for allowing said bullet to be selectively fired with the pressurized gas supplied into said inner chamber of said housing, a tubular member rotatably received in said inner chamber of said housing and including a bore formed therein, and including an opening formed therein and communicated with said bore of said tubular member for selectively aligning with said feed tube and for selectively receiving said bullet into said bore of said tubular member, and said opening of said tubular member acting to open or close said feed tube when said tubular member is rotated relative to said housing, a rotating device for rotating said tubular member relative to said housing, and a controlling device for controlling the pressurized gas to flow into said inner chamber of said housing and to fire said bullet, wherein said rotating device includes at least one helical groove, an actuating rod and a pin, said helical groove is formed in said tubular member and is communicated with said bore of said tubular member, said actuating rod is slidably engaged into said bore of said tubular member, and said pin is attached to said actuating rod and has at least one end slidably engaged in said at least one helical groove of said tubular member for rotating said tubular member relative to said housing with said actuating rod.

2. The gun device as claimed in claim 1, wherein said housing includes an inner peripheral shoulder formed therein for engaging with said tubular member and for rotatably anchoring said tubular member to said housing.

3. The gun device as claimed in claim 1, wherein said housing includes at least one sealing ring engaged between said tubular member and said housing for rotatably anchoring said tubular member to said housing.

4. The gun device as claimed in claim 1, wherein said housing includes a cylinder disposed in said inner chamber of said housing and having an inner space formed therein, said actuating rod is slidably engaged into said inner space of said cylinder.

5. The gun device as claimed in claim 4, wherein said cylinder includes a piston slidably received in said inner space of said cylinder for separating said inner space of said cylinder into a front compartment and a rear compartment, and a gasket disposed in said cylinder for slidably engaging with said actuating rod, said actuating rod is secured to said piston.

6. The gun device as claimed in claim 5, wherein said cylinder includes an end cap attached thereto for enclosing said inner space and said rear compartment of said cylinder.

7. The gun device as claimed in claim 1, wherein said tubular member includes an outer peripheral channel formed therein and aligned with said gas supplying passage of said housing for receiving the pressurized gas from the gas supplying source.

8. The gun device as claimed in claim 7, wherein said tubular member includes a peripheral fence for forming said outer peripheral channel thereof, and said peripheral fence includes at least one aperture formed therein for communicating said outer peripheral channel with said bore of said tubular member and for allowing the pressurized gas to flow into said bore of said tubular member though said at least one aperture of said peripheral fence.

9. The gun device as claimed in claim 1, wherein said tubular member includes an orifice formed therein, said housing includes a spring-biased projection disposed therein and engageable into said orifice of said tubular member for selectively engaging with said bullet and for retaining said bullet in said bore of said tubular member when said orifice of said tubular member is aligned with said spring-biased projection.

10. The gun device as claimed in claim 1, wherein said controlling device includes a valve seat provided in said tubular member, a valve stem slidably received in said bore of said tubular member and having a valve member for selectively engaging with said valve seat of said tubular member and for selectively enclosing said bore of said tubular member.

11. The gun device as claimed in claim 10 further comprising a biasing means for biasing said valve member to engage with said valve seat of said tubular member.

* * * * *